US007798060B2

(12) United States Patent
Pearson et al.

(10) Patent No.: US 7,798,060 B2
(45) Date of Patent: Sep. 21, 2010

(54) MODULAR STRAP DISPENSER WITH FEED MOTOR

(75) Inventors: Timothy B. Pearson, Antioch, IL (US); Torsten Oehm, Wuppertal (DE)

(73) Assignee: Illinois Tool Works Inc., Glenview, IL (US)

( * ) Notice: Subject to any disclaimer, the term of this patent is extended or adjusted under 35 U.S.C. 154(b) by 332 days.

(21) Appl. No.: 11/923,300

(22) Filed: Oct. 24, 2007

(65) Prior Publication Data

US 2009/0108042 A1 Apr. 30, 2009

(51) Int. Cl.
*B65B 13/18* (2006.01)
*B65H 16/00* (2006.01)
*B65H 5/00* (2006.01)

(52) U.S. Cl. ..... 100/26; 100/29; 226/1; 226/24; 226/118.4; 242/417; 242/588.6; 221/1

(58) Field of Classification Search ..... 100/26, 100/29, 32, 33 R, 34; 53/399, 589; 221/1, 221/258; 226/1, 24, 118.4; 242/417, 422.2, 242/422.6, 588.6

See application file for complete search history.

(56) References Cited

U.S. PATENT DOCUMENTS 3,137,426 A 6/1964 Brenneisen
3,884,139 A * 5/1975 Pasic ..... 100/26
3,946,921 A 3/1976 Noguchi
4,120,239 A * 10/1978 Pasic et al. ..... 100/26
4,651,944 A 3/1987 Bader, Jr.
4,982,636 A * 1/1991 Becking ..... 83/167
5,112,004 A 5/1992 Tipton
5,613,432 A * 3/1997 Hoshino ..... 100/26
6,418,838 B1 7/2002 Bobren et al.
2004/0250697 A1 * 12/2004 Devine et al. ..... 100/26
2007/0007300 A1 * 1/2007 Cranston, III et al. ..... 221/226

* cited by examiner

*Primary Examiner*—Jimmy T Nguyen
(74) *Attorney, Agent, or Firm*—Levenfeld Pearlstein, LLC

(57) ABSTRACT

A modular strap dispenser for a strapping machine comprises includes a mount for rotatably mounting a coiled spool of strap and a feeding mechanism for drawing strap directly from the spool, feeding the strap directly to the strapping machine and retracting and tensioning the strap. The feeding mechanism is driven by a variable speed feed motor controlled by a feed motor controller. The feed motor controller is operatively connected to a strapper control system that controls both the feed motor controller and the strapping head of the strapping machine. The dispenser may include a braking system to control the rotation of the spool. The dispenser also may include an accumulator box configured to accept and store take-up strap generated during strap tensioning. The dispenser may further include a strap guide for guiding the strap from the spool to the feeding mechanism.

2 Claims, 8 Drawing Sheets

MODULAR STRAP DISPENSER WITH FEED MOTOR

BACKGROUND OF THE INVENTION

The present invention pertains to strapping machines. More particularly, the present invention pertains to a modular strap dispenser for a strapping machine, the dispenser having a feed motor to control the feeding of strap directly from the dispenser to the strapping machine, without the need for a strap storage box.

Strapping machines are well known in the art. These machines, also referred to as strappers, are used for positioning, tensioning and sealing a strap around a load. Strapping machines are used for a wide variety of objects from piles of lumber to newspapers and magazines to bales of hay and cotton.

Strapping machines typically include a strapping head and a strap chute mounted to a frame that defines an opening configured to receive a load to be strapped. In most prior art strappers, the strapping head draws a length of strap from a strap supply (typically a coiled spool mounted to a strap dispenser) and feeds the strap around the load through a strap chute. The strapping head then tensions the strap in a tensioned loop around the load, welds the strap in the tensioned state and severs the strap from the supply, thereby forming a tensioned loop about the load.

During the tensioning cycle, a typical strapping head uses motorized feeding mechanism having a pair of feeding rollers to draw the strap forwardly into the strapping machine, through the strap chute and around the load, and a pair of tensioning (or take-up) rollers to draw the strap backwardly past the strapping head and in the direction away from the strapping machine in order to tension the strap.

Since the strapping process inherently involves the repeated, intermittent drawing of strap from the strap supply, and since strap typically is stored in a tightly-wound manner on large, heavy spools having high moments of inertia, the prior art has utilized a strap "storage box" to provide a readily-available amount of "unspooled" strap to the strapping head.

Storage boxes store a length of the strap drawn from the strap supply before the strap is drawn by the strapping head into the strap chute and around the load. In this manner, the unspooled strap in the storage box is available to be used by the strapping head without the inertial resistance associated with drawing the strap directly off of the spool. This results in a more efficient strapping process.

Many prior art storage boxes comprise a box having multiple motorized feeding mechanisms controlled by a sensor. An input feeding mechanism draws strap from the spool and into the storage box. An output feeding mechanism draws strap from the storage box and directs it to the strapping head. The sensor detects the amount of strap in the box and activates the input feeding mechanism when the amount of strap in the box falls below a set level, such as when a length of strap is drawn out of the box by the output feeding mechanism in order to supply strap to the strapping head.

In this manner, a consistent amount of unspooled strap is maintained in the storage box and is available to the strapping head without the need to retrieve the strap directly from the spool. Moreover, the strap stored in the storage box is maintained in a generally non-tensioned state, thereby facilitating the retrieval of the strap by the strapping head over repeated strapping operations.

An additional feature of the storage box is that it provides a place to store "take-up" strap drawn by the strapping head during the tensioning process. During tensioning, such take-up strap is drawn backwardly past the strapping head and in the direction away from the strapping machine in order to tension the strap. The storage box accepts the take-up strap and stores it in preparation for use in the next strapping operation.

While strap storage boxes are an advantageous feature of prior art strapping machines, it would be desirable to eliminate the need for such strap storage boxes in order to simplify the overall design and operation of strapping machines and to reduce cost. Additionally, by decreasing the number of motorized feed mechanisms, the potential for strap misfeeds also would be decreased.

For example, it would be advantageous to use a single feeding mechanism to control the flow of strap from the dispenser, to direct the strap around the strap chute and to tension the strap about the load, rather than using an first input motor to draw the strap from the spool into the strap storage box, a second output motor to draw the strap from the strap storage box to the strapping head and a third motorized feeding mechanism at the strapping head to direct the strap around the strap chute and to tension the strap about the load.

Accordingly, there exists a need for a strap dispenser having a feed motor for use with a strapping machine. Desirably, the dispenser eliminates the need for a strap storage box by providing strap to the strapping machine on demand. More desirably, the dispenser includes an accumulator box for storing take-up strap. More desirably still, the dispenser has a single feed motor configured to draw the strap directly from the coiled spool, feed the strap to the strapping machine, feed the strap around the strap chute of the strapping machine and tension the strap about the load. More desirably yet, the dispenser includes a controller configured to control the speed and direction of the feed motor. Most desirably, the strap dispenser is modular and may work in conjunction with several different types of strapping machines.

BRIEF SUMMARY OF THE INVENTION

A modular strap dispenser for a strapping machine comprises a frame with a mount for rotatably mounting a coiled spool of strap.

The dispenser further comprises a strap feeding mechanism also mounted to the frame and disposed in proximity to the spool. The strap feeding mechanism is configured to frictionally engage the strap and to draw the strap from the spool, to feed the strap to strapping machine and to feed the strap around the strap chute of the strapping machine.

The feeding mechanism is further configured to retract and tension the strap to a desired tension about a load disposed within the frame of the strapping machine and to hold the tensioned strap while a strapping head welds the tensioned strap and severs the welded strap loop from the strap source.

The feeding mechanism is driven by a feed motor. The feed motor is operatively connected to a feed motor controller configured to control the speed of the feed motor such that the speed of the feed motor, and thus the speed at which the strap is drawn from the spool and fed to the strapping machine, is continuously adjustable and may be stopped and started, and slowed and accelerated, as necessary, during repeated strapping operations. The controller also controls the direction of the feed motor such that strap may be drawn from the spool and fed to the strapping machine during strap loading, and drawn from the strapping machine toward the dispenser during strap tensioning.

The feed motor controller preferably is operatively connected to a strapper control system that controls both the feed motor controller and the strapping head of the strapping machine. In this manner, the strap feeding, tensioning, welding and severing operations are synchronized.

The dispenser may include a braking system, such as an electromagnetic braking system, to control the rotation of the spool on the mount.

The dispenser preferably includes an accumulator box disposed in proximity to the feed motor and between the feed motor and the strap spool. The accumulator box is configured to accept and store take-up strap generated during strap tensioning.

When an accumulator box is used, the feed motor controller preferably is configured to monitor the length of take-up strap directed to the accumulator box during the prior strapping operation. Upon initiation of the next strapping operation, the feed motor controller activates the feed motor at a high speed to rapidly feed the take-up strap disposed in the accumulator box to the strapping machine and, once the take-up strap is removed from the accumulator box, the feed motor controller decreases the feed motor speed as the strap is drawn directly from the spool.

In one embodiment of the dispenser of the present invention, the dispenser may include a strap guide for guiding the strap from the spool to the strap feeding assembly.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein:

FIG. 8 is a side view of a second embodiment of the modular dispenser in accordance with the principles of the present invention shown while feeding strap; and.

DETAILED DESCRIPTION OF THE INVENTION

Figure 1:
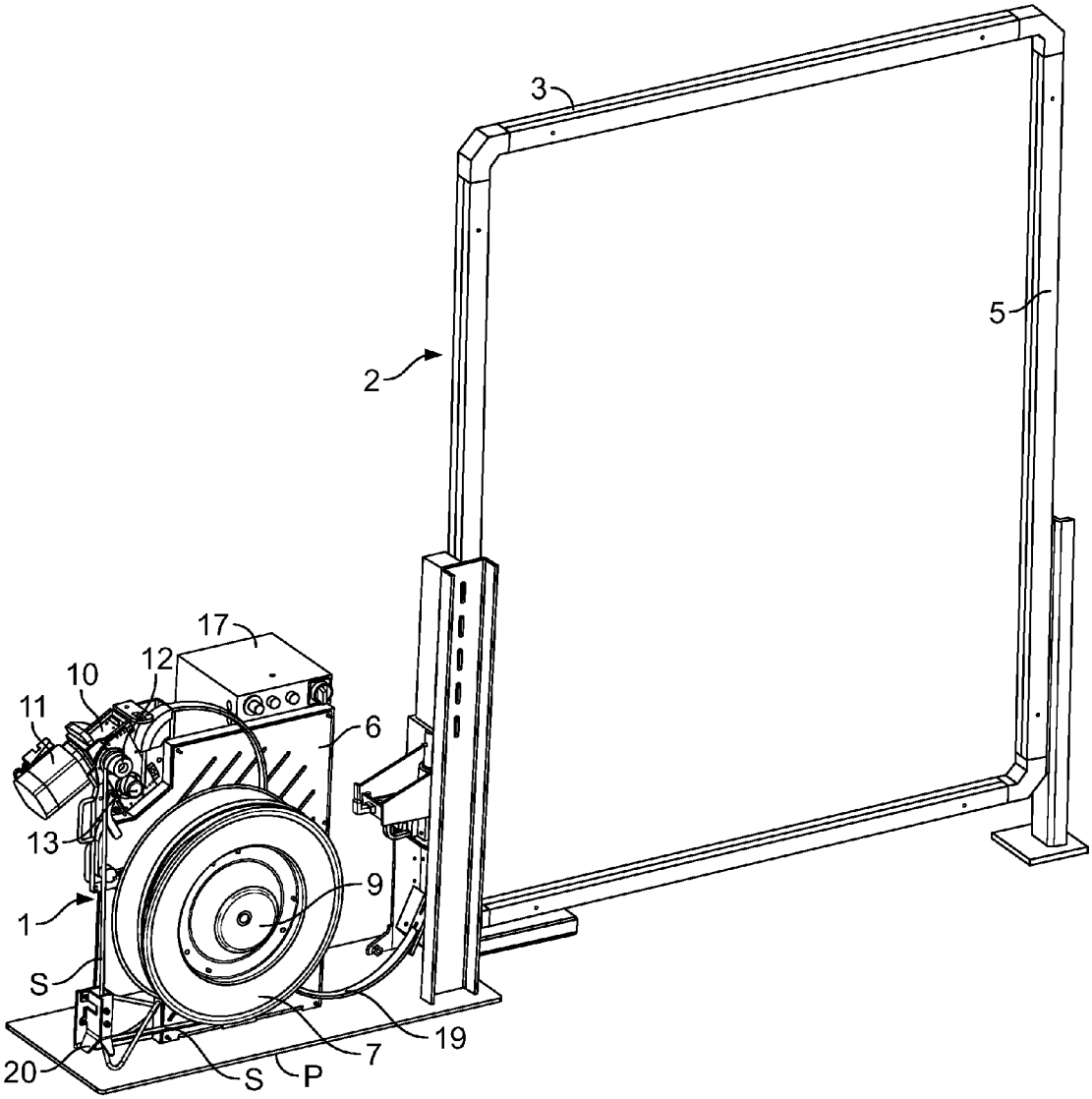
FIG. 1 is a front perspective view of a first embodiment of the modular dispenser in accordance with the principles of the present invention shown disposed adjacent to a strapping machine.

While the present invention is susceptible of embodiment in various forms, there are shown in the drawings and will hereinafter be described several preferred embodiments with the understanding that the present disclosure is to be considered an exemplification of the invention and is not intended to limit the invention to the specific embodiments illustrated.

It should be further understood that the title of this section of the specification, namely, "Detailed Description of the Invention," relates to a requirement of the United States Patent and Trademark Office, and does not imply, nor should be inferred to limit the subject matter disclosed herein.

The modular strap dispenser of the present invention is configured to be used in connection with a strapping machine. The design and operation of strapping machines is well known in the art.

Figure 2:
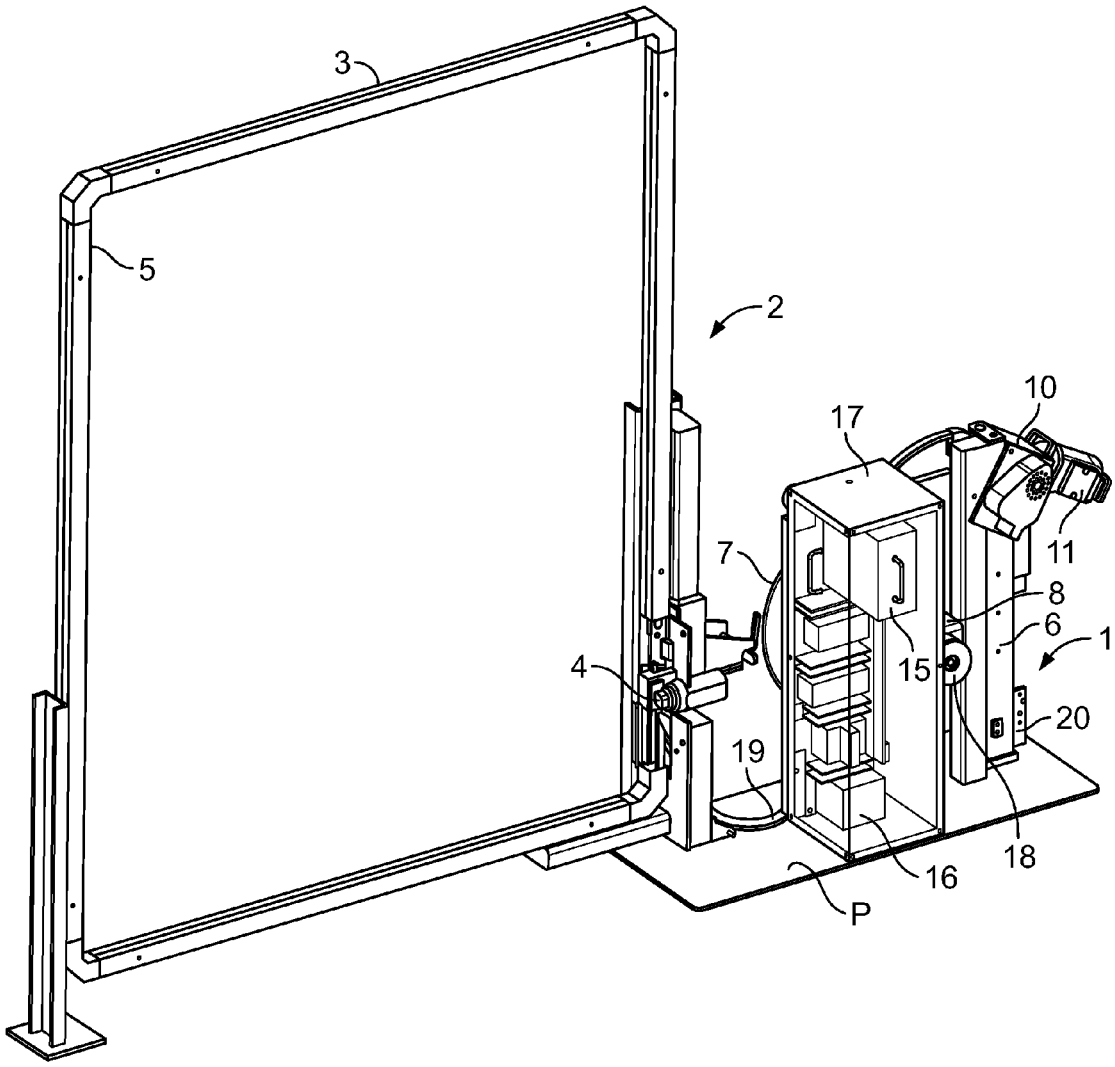
FIG. 2 is a rear perspective view of the first embodiment of the modular dispenser in accordance with the principles of the present invention shown disposed adjacent to a strapping machine.

As shown in FIGS. 1 and 2, strapping machine 2 includes, generally, a strapping machine frame 3, a strapping head 4 mounted to strapping machine frame 3, and a strap chute 5 mounted to the strapping machine frame 3. Frame 3 generally defines an area in which a load (not shown) may be placed in order to be strapped.

In operation, strap is fed around strap chute 5 to surround the load and the strap is then tensioned, causing the strap to release from strap chute 5 and engage the load. After the strap is tensioned to the desired tension, the strapping head 4 seals or welds the strap to itself and severs it from the strap source (the dispenser).

A first embodiment of the modular strap dispenser of the present invention is shown in FIGS. 1-4 disposed adjacent to a strapping machine 2 (while FIGS. 1-4 depict dispenser 1 as sharing a common mounting platform P with strapping machine 2, it will be appreciated that modular nature of dispenser 1 allows it to be disposed adjacent or in close proximity to strapping machine 2 without the use of common mounting platform P).

In the first embodiment, dispenser 1 is disposed in a vertical orientation and comprises a frame 6. Frame 6 is a generally vertical structure and is configured to support a spool 7 of strap S in a generally vertical configuration. Since spool 7 typically is large and heavy, frame 6 preferably is constructed of steel or another material of sufficient strength to support spool 7. Frame 6 is further configured to support the additional components of dispenser 1 as further discussed below.

Spool 7 is rotatably and removably mounted to the front of frame 6 on an axle (not shown) extending from a bracket 8 mounted to the rear of frame 6. Spool 7 is secured to the axle using an end cap 9 threadedly mounted to the axle.

Dispenser 1 further comprises a strap feeding mechanism 10 also mounted to frame 6 of dispenser 1. Strap feeding mechanism 10 preferably is disposed adjacent or in close proximity to spool 7 (in the present embodiment, strap feeding mechanism is disposed above spool 7) such that strap feeding mechanism 10 can draw strap S from spool 7 and direct strap S to strapping machine 2.

Strap feeding mechanism 10 is configured to engage strap S, to draw strap S from spool 7, to direct strap S to strapping machine 2 and to push strap S around strap chute 5 of strapping machine 2. Strap feeding mechanism 10 is further configured to retract and tension strap S to a desired tension about a load disposed within frame 3 of strapping machine 2 and to hold the tensioned strap S while strapping head 4 welds the tensioned strap S and severs the welded strap loop from dispenser 1.

Figure 3:
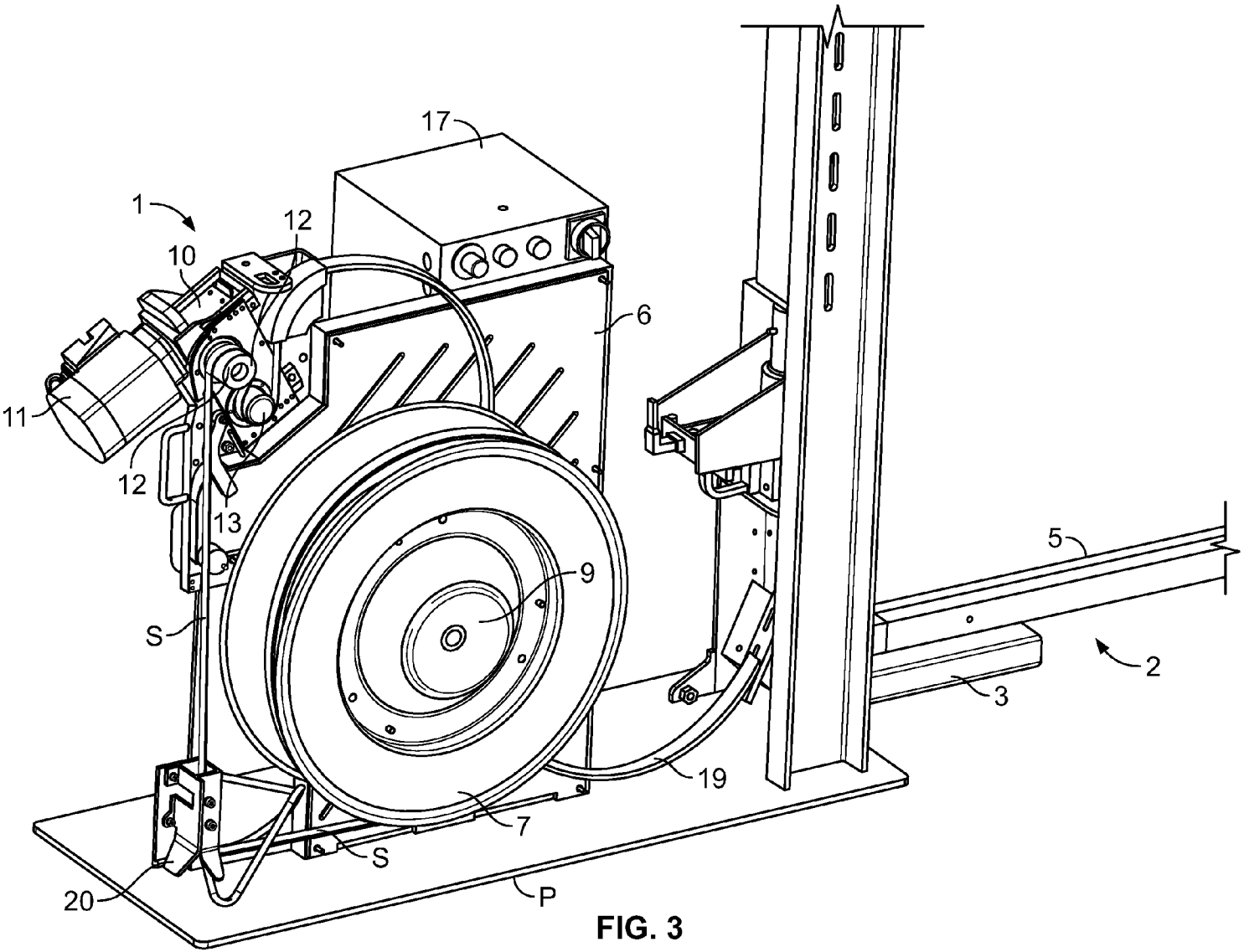
FIG. 3 is an enlarged front perspective view of the first embodiment of the modular dispenser in accordance with the principles of the present invention shown disposed adjacent to a strapping machine.
Figure 4:
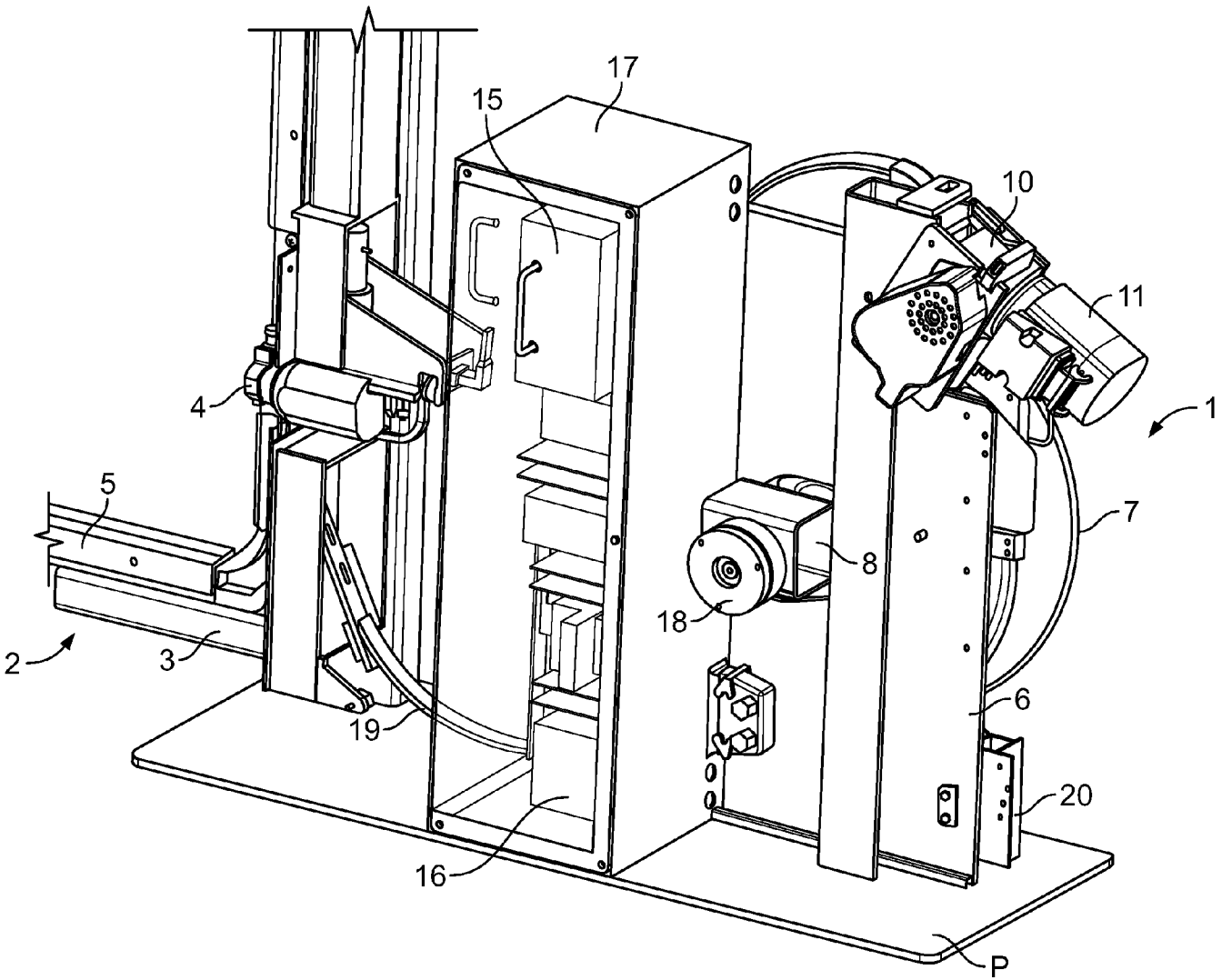
FIG. 4 is an enlarged rear perspective view of the first embodiment of the modular dispenser in accordance with the principles of the present invention shown disposed adjacent to a strapping machine.

To that end, strap feeding mechanism 10 comprises a pair of opposed rollers 12, 13 rotatably mounted to strap feeding mechanism 10. Rollers 12, 13 are configured to frictionally engage strap S as strap S passes therebetween. In the preferred embodiment, strap feeding mechanism 10 is configured such that strap S passes over roller 12 and under roller 13, as shown in FIGS. 1 and 3. In this manner, strap S remains relatively taut when rollers 12, 13 are rotated.

Roller 12 is driven by a feed motor 11 such when roller 12 is driven in a clockwise direction by motor 11 (when strap S is being pulled from spool 7), strap S causes roller 13 (which is not driven by feed motor 11) to rotate in a counter-clockwise direction. Similarly, when roller 12 is driven in a counter-clockwise direction (when strap S is being retracted during the tensioning process), strap S causes roller 13 to rotate in a clockwise direction.

Feed motor 11 is preferably a variable speed electric motor as is known in the art and is configured to drive roller 12 using a direct drive gear mechanism. In some embodiments, the feed motor 11 may include a mechanical slip clutch to improve performance when feed motor 11 operates at higher feeding speeds.

Feed motor 11 is operatively connected to and controlled by a feed motor controller 15. Feed motor controller 15 is configured to control the speed of feed motor 11 such that the speed of the feed motor 11, and thus the speed at which strap S is drawn from spool 7 and fed to strapping machine 2, is continuously adjustable and feed motor 11 may be stopped and started, and slowed and accelerated, as necessary, during the feeding and tensioning of strap S.

Feed motor controller 15 also is configured to control the direction of feed motor 11 such that strap S may be drawn from spool 7 and fed to strapping machine 2 during strap loading, and drawn from strapping 2 machine toward dispenser 1 during strap tensioning.

Feed motor controller 15 preferably is operatively connected to a strapper control system 16 that is configured to control both feed motor controller 15 and strapping head 4 of strapping machine 2. In this manner, the feeding, tensioning, welding and severing of strap S may be synchronized. In the preferred embodiment, feed motor controller 15 and strapper control system 16 are located in a housing 17 disposed on the rear side of dispenser 1.

In the present embodiment, dispenser 1 also includes a braking system to control the rotation of spool 7. Braking system preferably comprises an electromagnetic brake 18 as known to those skilled in the art. Electromagnetic brake 18 engages the axle upon which spool 7 is mounted and, upon activation of electromagnetic brake 18, slows the rotation of spool 7.

Electromagnetic brake 18 is operatively connected to strapper control system 16 such that strapper control system 16 controls the activation and deactivation of electromagnetic brake 18. In this manner, strapper control system 16 can slow the rotation of spool 7 after a sufficient length of strap S has been drawn from spool 7 to complete a strapping operation.

In the present embodiment, dispenser 1 further includes a chute 19 for directing strap S from feeding mechanism 10 to strapping head 4 of strapping machine 2. However, it will be appreciated that chute 19 is not required in all embodiments of the present invention.

Figure 5:
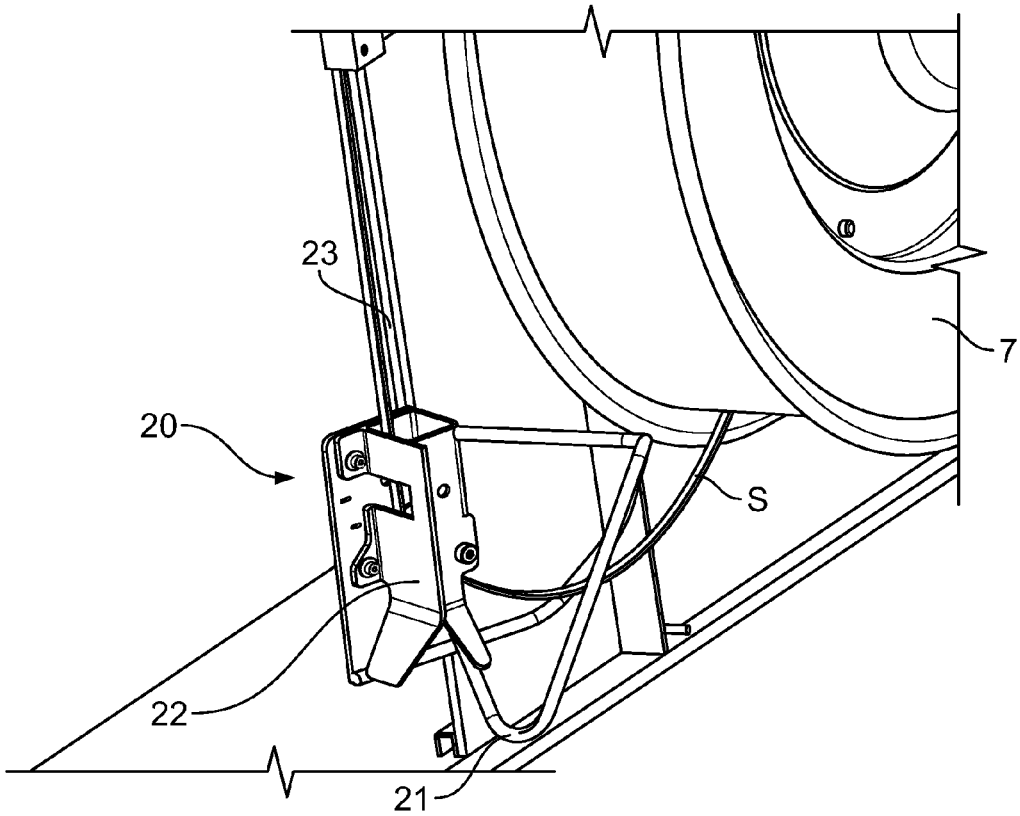
FIG. 5 is an enlarged perspective view of the first embodiment of the modular dispenser in accordance with the principles of the present invention showing the feed bracket assembly.
Figure 6:
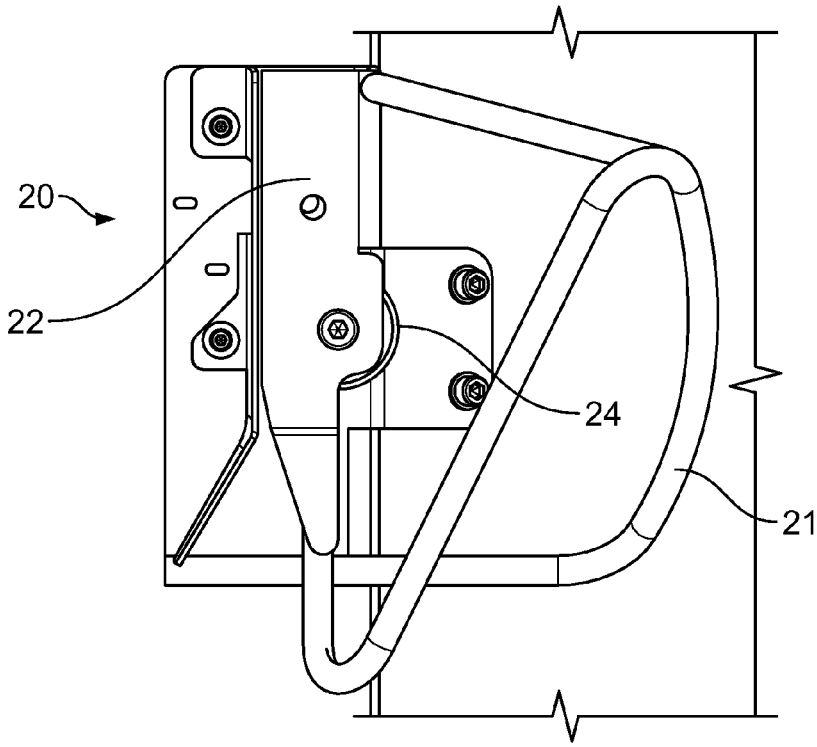
FIG. 6 is an enlarged side view of the feed bracket assembly of FIG. 5.
Figure 7:
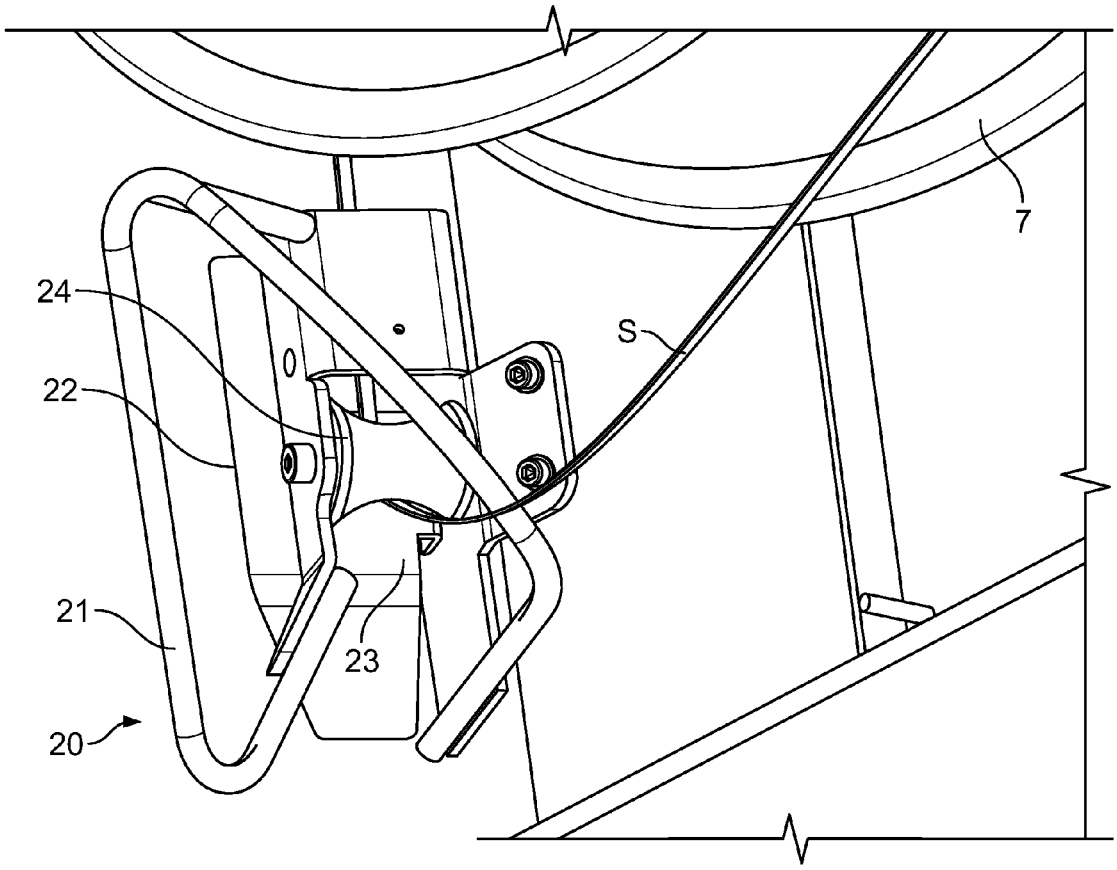
FIG. 7 is an enlarged front perspective view of the feed bracket assembly of FIG. 5.

Dispenser 2 also includes, in the present embodiment, a strap guide 20 for directing strap S from spool 7 to feeding mechanism 10, as shown in FIGS. 5-7. Strap guide 20 comprises a bracket 21 mounted to a housing 22 that defines a channel 23 through which strap S passes. Disposed within housing 22 and extending at least in part into channel 23 is a guide roller 24 rotatably mounted to housing 22.

Strap guide 20 is configured to permit strap S to be dispensed from the underside of spool 7 in a generally horizontal direction, to pass through bracket 21 and to enter channel 23 and engage guide roller 24, thereby changing the direction of strap S from a generally horizontal direction to a generally vertical direction and directing strap S toward feeding mechanism 10. Strap guide 20 may be of an open design (as shown in FIGS. 5-7), or may include a cover (not shown) that extends upwardly from strap guide 20 to feeding mechanism 10 in order to protect the strap during travel.

The operation of dispenser 1 of the present embodiment is controlled by strapper control system 16. Strap S is first loaded from spool 7, through strap guide 20, through feeding mechanism 10 and through chute 19 to strapping head 4 of strapping machine 2. When a strapping operation is to be initiated, strapper control system 16 causes feed motor controller 15 to activate feed motor 11 in order to drive roller 12 clockwise to draw strap S from spool 7.

Strap S is directed around strap chute 5 until strap S returns to strapping head 4. Strapper control system 16 then causes feed motor controller 15 to deactivate feed motor 11 and activates electromagnetic brake 18 to stop the rotation of spool 7. After strapping head 4 has gripped the end of strap S, strapper control system 16 then causes feed motor controller 15 to activate feed motor 11 in order to drive roller 12 counter-clockwise to draw strap S away from strapping machine 2, thereby causing strap S to exit strap chute 5 and tension about a load.

When strap S has been sufficiently tensioned, strapper control system 16 causes strapping head 4 to weld strap S to itself and to sever the welded loop of strap S from spool 7. Strapper control system 16 then feeds a new length of strap S around strap chute 5 in preparation for the next strapping operation.

The speed of feed motor 11 may vary such that strap S may be fed around strap chute 5 at a one speed during loading, but retracted a different speed during tensioning. Additionally, the speed of feed motor 11 may be variable (increasing or decreasing), such that the speed of strap S may increase (accelerate) when being loaded into strap chute 5 and decrease (decelerate) when being tensioned.

Figure 8:
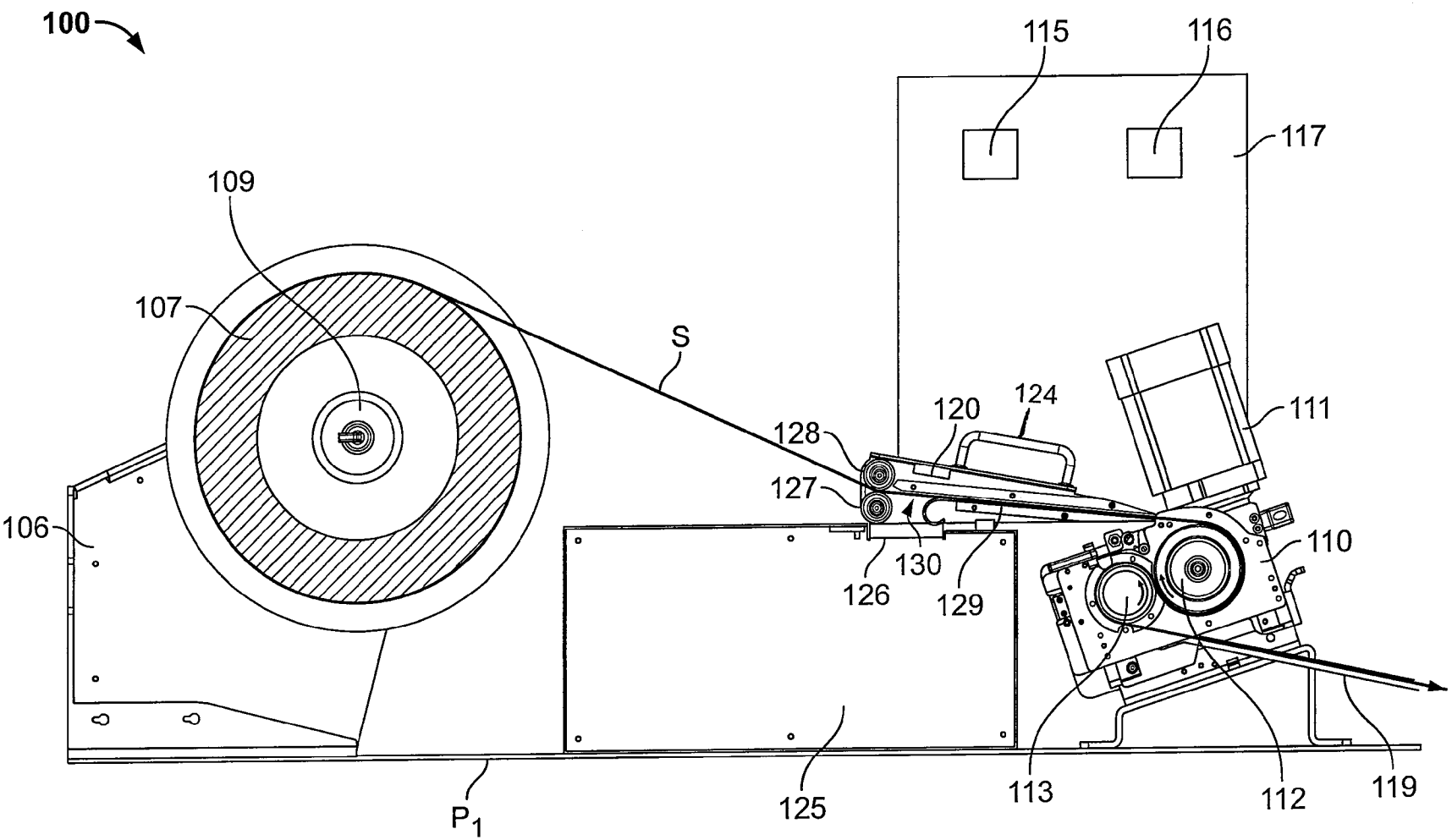
Figure 9:
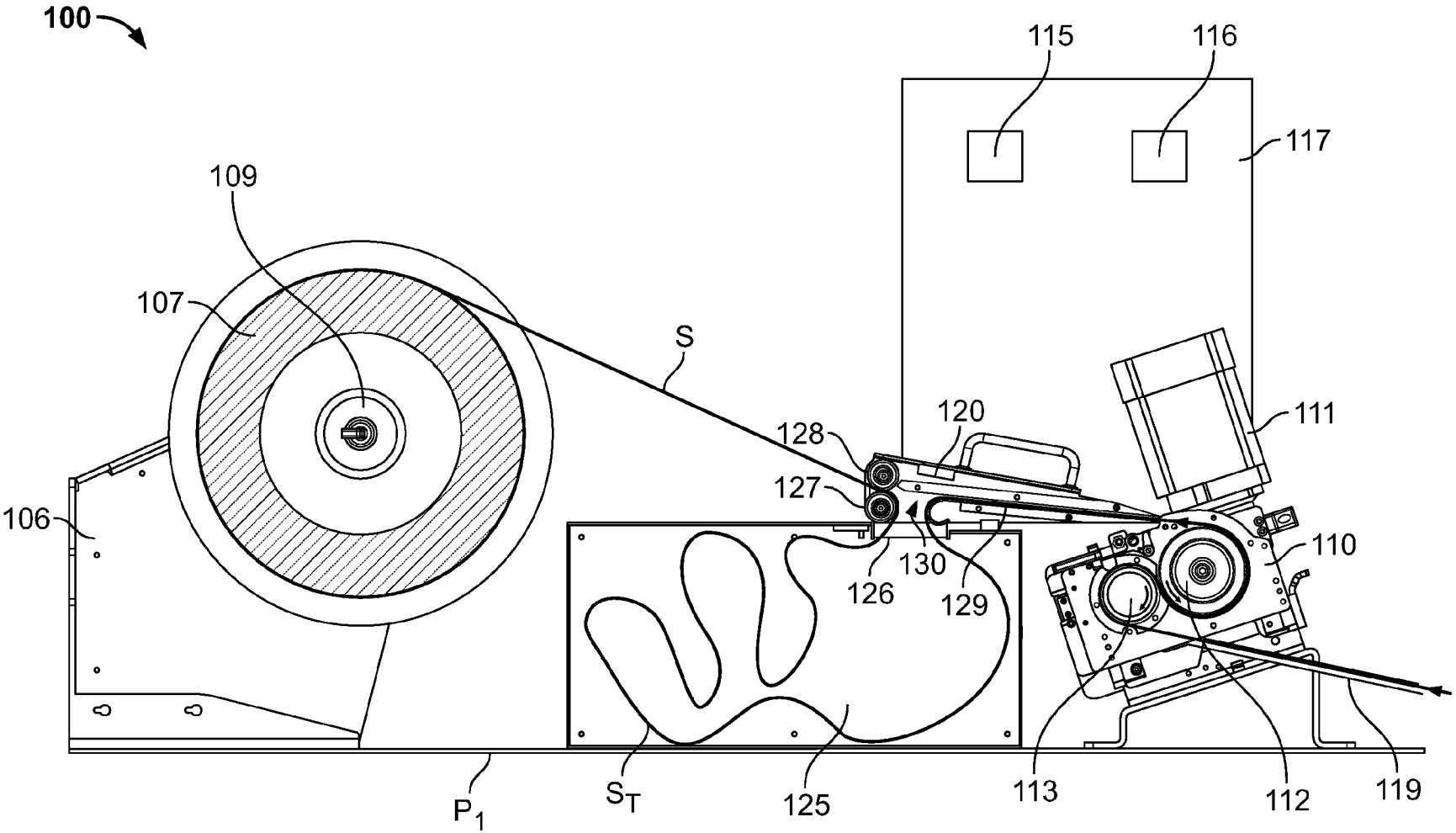
FIG. 9 is a side of view the second embodiment of the modular dispenser in accordance with the principles of the present invention shown while taking-up strap.

A second embodiment of the modular dispenser of the present invention is shown in FIGS. 8 and 9. In this embodiment, dispenser 100 is disposed in a generally horizontal orientation and comprises a frame 106 mounted on a mounting platform $P_1$.

Frame 106 is a generally vertical structure and is configured to support a spool 107 of strap S. Like frame 6 of the first embodiment, frame 106 preferably is constructed of steel or another material of sufficient strength to support spool 107.

Spool 107 is rotatably and removably mounted to the front of frame 106 on an axle (not shown) extending from frame 106. Spool 107 is secured to the axle using an end cap 109 threadedly mounted to the axle.

Dispenser 100 further comprises a strap feeding mechanism 110 also mounted to mounting platform $P_1$ of dispenser 100. Strap feeding mechanism 110 is configured in an identical manner as strap feeding mechanism 10 in the first embodiment, and comprises a pair of opposed rollers 112, 113 rotatably mounted to strap feeding mechanism 110. Roller 112 is driven by a variable speed feed motor 111.

Feed motor 111 is operatively connected to and controlled by a feed motor controller 115 as in the first embodiment of the present invention discussed above. Feed motor controller 115 is configured to control the speed and direction of feed motor 111 such that strap S may be stopped and started, slowed and accelerated, and fed and retracted as necessary, during the strapping operation.

Like dispenser 1 in the first embodiment, dispenser 100 also includes a strapper control system 1 16 configured to control feed motor 115 and to synchronize the feeding, tensioning, welding and severing of strap S. Feed motor controller 115 and strapper control system 116 are disposed in a housing 117 mounted on mounting platform $P_1$.

In the present embodiment, dispenser 100 preferably includes an electromagnetic brake (not shown) to control the rotation of spool 107. The electromagnetic brake is controlled by strapper control system 116 and operates in an identical manner as electromagnetic brake 18 of the first embodiment.

In the present embodiment, dispenser 100 further includes a chute 119 for directing strap S from feeding mechanism 110 to the strapping head of the strapping machine. However, it will be appreciated that chute 119 is not required in the present embodiment.

Dispenser 100 of the present embodiment further comprises an accumulator box 125. Accumulator box 125 preferably is mounted to mounting platform $P_1$ and is disposed between spool 107 and feeding mechanism 110.

Accumulator box 125 is configured to store strap S as strap S is retracted during the tensioning process. As such, accumulator box 125 is a generally narrow (its width being only slightly greater than the width of strap S), box-like structure having an opening 126 formed along its top. A strap guide 120 is mounted above opening 126 and extends from accumulator box 125 to feeding mechanism 110. A handle 124 is attached to the strap guide 120.

Strap guide 120 comprises a pair of opposing intake rollers 127, 128 at the entrance of strap guide 120. Rollers 127 and 128 are configured to frictionally engage and guide strap S into a channel 129 formed in the body of strap guide 120 and extending from an entry side of strap guide 120 to an exit side of strap guide 120. Channel 129 is configured with an opening 130 disposed above opening 126 of accumulator box 125, such that as strap S is retracted by feeding mechanism 110 during the tensioning process, the take-up strap $S_T$ (shown in FIG. 9) enters accumulator box 125 through opening 130 of channel 129 and opening 126 of accumulator box 125.

The operation of dispenser 100 of the present embodiment is controlled by strapper control system 116. Strap S is first loaded from spool 107, directed through strap guide 120, through feeding mechanism 110 and through chute 119 to the strapping head of the strapping machine. When a strapping operation is to be initiated, strapper control system 116 causes feed motor controller 115 to activate feed motor 111 in order to drive roller 112 clockwise to draw strap S from spool 107.

Strap S is directed around the strap chute of the strapping machine until strap S returns to the strapping head 4. Strapper control system 116 then causes feed motor controller 115 to deactivate feed motor 111 and activates the electromagnetic brake to stop the rotation of spool 107.

After the strapping head has gripped the end of strap S, strapper control system 116 then causes feed motor controller 115 to activate feed motor 111 in order to drive roller 112 counter-clockwise to draw strap S away from the strapping machine, thereby causing strap S to exit the strap chute and tension about the load.

As strap S is tensioned, take-up strap $S_T$ is drawn toward accumulator box 125 and, because of the frictional engagement of strap S by intake rollers 127, 128, is forced enter accumulator box 125 through opening 130 of channel 129 and opening 126 of accumulator box 125.

When strap S has been sufficiently tensioned, strapper control system 116 causes the strapping head to weld strap S to itself and to sever the welded loop of strap S from spool 107. Strapper control system 116 then feeds a new length of strap S to the strapping machine in preparation for the next strapping operation.

The speed of feed motor 111 may vary such that strap S may be fed around strap chute 5 at a one speed during loading, but retracted a different speed during tensioning. Additionally, the speed of feed motor 111 may be variable (increasing or decreasing), such that the speed of strap S may increase (accelerate) when being loaded into the strap chute and decrease (decelerate) when being tensioned.

Advantageously, in one embodiment of the present invention, feed motor controller 115 can be programmed to monitor the length of take-up strap $S_T$. In this embodiment, feed motor controller 115 is programmed to activate feed motor 111 at a relatively low speed during the initial loading of strap S from spool 107 to the strapping machine. The length of take-up strap $S_T$ stored in accumulator box 125 after the first strapping operation is monitored by feed motor controller 115.

Upon initiation of the subsequent strapping operation, feed motor controller 115 causes feed motor 111 to operate at a relatively high speed while the take-up strap $S_T$ from the prior strapping operation (which is unspooled and in a generally non-tensioned state) is fed to the strapping machine from accumulator box 125.

When the take-up strap $S_T$ stored in accumulator box 125 is nearing depletion (based on the length of take-up strap $S_T$ fed to the strapping machine), feed motor controller 115 causes feed motor 111 to decrease its speed as strap S begins to be drawn directly from spool 107. After strap S begins to be drawn directly from spool 107, feed motor controller 115 increases the speed of feed motor 111 to accelerate the speed of strap S as it is directed around the strap chute of the strapping machine. The process then is repeated for subsequent strapping operations.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

What is claimed is:

1. A modular dispenser for dispensing a strap material to a strapping machine, the dispenser comprising:

a frame;

a mount for rotatably mounting a spool of strap material, the mount being mounted to the frame;

a strap material feeding mechanism having a feed motor, the strap feeding mechanism mounted to the frame;

a feed motor controller for controlling the feed motor;

an electromagnetic brake for controlling the rotation of the spool;

a strapper control system for controlling the feed motor controller, the electromagnetic brake and a strapping head disposed on the strapping machine, the strapper control system configured to synchronize feeding, tensioning, welding and severing of the strap material;

an accumulator box for storing a length take-up strap material created when the strap material is tensioned, the accumulator box further comprising a strap guide, the strap guide having a pair of opposing intake rollers configured to frictionally engage the strapping material a handle is attached to the strap guide, and an opening configured to permit the length of take-up strap material to enter the accumulator box, wherein the strap guide is mounted above the opening and extended from the accumulator box to the strap material feeding mechanism;

wherein the strap material feeding mechanism is configured to draw the length of take-up strap material stored in the accumulator box and to deliver the length of take-up strap material to the strapping machine, to draw the strap material from the spool of strap material, to deliver the strap material to the strapping machine, and to retract and tension the strapping material; and wherein the feed motor operates at a first speed when the length of take-up strap material is fed to the strapping machine from the accumulator box, and at a second speed when the strap material is fed to the strapping machine from the spool, wherein the feed motor decreases the first speed as the take-up strap material is depleted from the accumulator box, and wherein the first speed is different from the second speed.

2. A method for dispensing a strap material from a modular dispenser to a strapping machine, comprising the steps of:

providing a modular dispenser, the modular dispenser having a mount for rotatably mounting a spool of strap material, a strap material feeding mechanism having a feed motor, a feed motor controller for controlling the feed motor, an accumulator box for storing a length take-up strap material created when the strap material is tensioned, the accumulator box having an opening for receiving the length of take-up strap material, a strap guide is mounted above the opening, and a handle is attached to the strap guide, wherein the strap guide extends from the accumulator box to the strap material feeding mechanism, and wherein the feeding mechanism is further configured to draw the length of take-up strap material stored in the accumulator box and to deliver the length of take-up strap material to the strapping machine, to draw the strap material from the spool of strap material, to deliver the strap material to the strapping machine, and to retract and tension the strapping material;

monitoring the length of take-up strap material created during a strapping operation and stored in the accumulator box;

feeding the length of take-up strap material stored in accumulator box to the strapping machine at a feed speed, the feed speed being a relatively high speed;

decreasing the feed speed as the take-up strap material is depleted from the accumulator box; and increasing the feed speed as the strap material is drawn from the spool.

* * * * *

UNITED STATES PATENT AND TRADEMARK OFFICE

CERTIFICATE OF CORRECTION

PATENT NO. : 7,798,060 B2
APPLICATION NO. : 11/923300
DATED : September 21, 2010
INVENTOR(S) : Timothy B. Pearson et al.

It is certified that error appears in the above-identified patent and that said Letters Patent is hereby corrected as shown below:

Column 7, Line 4: The reference identifier "1 16" should be replaced with "116".

Signed and Sealed this
Eighth Day of March, 2011

David J. Kappos

David J. Kappos
*Director of the United States Patent and Trademark Office*